US005876171A

United States Patent [19]

Martin et al.

[11] Patent Number: 5,876,171

[45] Date of Patent: Mar. 2, 1999

[54] ONE-OUT CONVERSION PRESS

[75] Inventors: Gregory S. Martin, Springfield; Kurt D. Dietrich, Miamisburg; Stephen G. Short, Dayton, all of Ohio

[73] Assignee: Dayton Reliable Tool & Mfg. Co., Dayton, Ohio

[21] Appl. No.: 853,421

[22] Filed: May 9, 1997

[51] Int. Cl.[6] ..... B21D 51/44

[52] U.S. Cl. ..... 413/14; 413/12; 413/66

[58] Field of Search ..... 413/66, 67, 12, 413/14, 15, 16

[56] References Cited

U.S. PATENT DOCUMENTS

| | | | |
|---|---|---|---|
| 3,196,817 | 7/1965 | Fraze | 113/1 |
| 3,231,065 | 1/1966 | Kaminski et al. | 198/131 |
| 3,642,120 | 2/1972 | Duhan | 198/203 |
| 3,712,483 | 1/1973 | Messervey | 214/6 BA |
| 4,568,230 | 2/1986 | Brown | 413/66 |
| 4,723,882 | 2/1988 | Wissman et al. | 413/66 |
| 4,932,822 | 6/1990 | De Silva et al. | 413/66 |
| 5,259,496 | 11/1993 | Common | 413/66 |
| 5,284,045 | 2/1994 | Herdzina | 413/66 |

*Primary Examiner*—James F. Coan

*Attorney, Agent, or Firm*—Wood, Herron & Evans,L.L.P.

[57] ABSTRACT

A conversion press (20) which is readily reconfigurable to process shells of different sizes includes an endless belt (68) having a single lane of apertures (86) formed therein for transporting shells (S) along a progression of end-forming tooling (60, 62) comprising seven stations (58*a–g*) along an end path (59) through the press. A tab-forming tooling path (100) extends from a tab stock feeder (104) to a tab-staking station (58*f*) adjacent the discharge end of the press, the tab-forming path oriented at an oblique angle to the end path. The tab-forming tools (94, 96) are mounted on tab bases (112, 110) which are slidably adjustable on stationary and reciprocating press members (34, 44) along the tab path toward and away from the tab-staking station. Shells are supplied to the belt by a servo-driven downstacker (120) having feed screws (126) which engage the edge (E) of a shell within a downstacker feed chute (122) and which are adjustably mounted on a downstacker platen (135) to permit their relocation to accommodate changing shell size. Reconfiguring the press to process shells of a different size from about 1 inch to about 4 inches in diameter is accomplished by changing the belt and the end tooling, adjusting the tab tooling bases to accommodate for change in end rivet location, and changing the feed chute and adjusting the downstacker feed screw positions to correspond to the new shell diameter.

25 Claims, 5 Drawing Sheets

ONE-OUT CONVERSION PRESS

FIELD OF THE INVENTION

The present invention relates to conversion presses for converting thin metal shells into easy-open can ends and, more particularly, to such presses which operate upon only one lane of shells at a time.

BACKGROUND OF THE INVENTION

Easy-open can ends are widely used for canning many beverages and food products. An easy-open can end typically has a tear panel which can be partially or completely separated from the remainder of the can end to create an opening in the end, and an attached operating tab which may be lifted upward at one end to cause the other end to impact the tear panel causing it to at least partially separate from the rest of the can end. The tab and the end are separately manufactured components, the tab being attached to the end by an integral rivet formed out of the parent material of the can end.

Easy-open can ends are manufactured in reciprocating presses known as conversion presses. A conversion press converts thin metal discs called "shells" into can ends, including the integral rivet and tear panel, and concurrently forms operating tabs from a separate strip of thin metal and attaches the tabs to the ends via the integral rivets. The finished product is an easy-open can end, which may later be attached to a can body following a canning operation.

A conversion press commonly has a lower stationary press member which supports a series of lower "end" tools for performing work operations on the shells, and an upper reciprocating press member which supports a like number of upper "end" tools for performing work operations on the shells. Each pair of upper and lower end tools defines a press "end station", and a typical conversion press has five or more such stations for converting shells into can ends. Shells are carried through the various end stations by a shell conveyor which alternately moves the shells forward and then brings them to rest into alignment with the end stations so that work operations can be performed on the shells. In synchronization with the intermittent motion of the shell conveyor, the reciprocating press member alternately moves toward the stationary press member to sandwich the shells between the upper and lower end tools and thereby perform work operations upon them, and then moves away from the stationary press member to disengage the end tools from the shells so that the shells may each be advanced to succeeding work stations.

A conversion press further includes a "downstacker" apparatus which supplies shells to the shell conveyor. The downstacker typically supports one or more stacks of shells and sequentially dispenses the shells into the intermittently moving shell conveyor in synchronization with the conveyor motion.

With each "stroke" of the reciprocating press member, a given shell is subjected to a single work operation. Conversion of the shell into a can end having an integral rivet and tear panel typically requires at least five separate work operations. The shell is "indexed" through the five or more press stations, moving from one station to the next station during each upward stroke of the reciprocating press member. One of the press stations is dedicated to attaching or "staking" an operating tab to the can end via an integral rivet formed in the can end.

The tabs are made within the conversion press via a progression of upper and lower tab-forming tooling supported on the reciprocating and stationary press members, respectively. The tab-forming tooling is likewise arranged into a series of stations, along a path separate from the end tooling path. A strip of thin metal tab stock is fed through the series of tab stations, emerging from the last station as a strip of fully formed tabs interconnected by a skeleton of stock material. This strip of tabs is fed to tab-staking tooling at the tab-staking station, where each tab is separated from the strip and attached to a can end.

Because easy-open can ends are in high demand, press designers are constantly striving to increase the speed of conversion presses. This has led to the development of belt-based conversion presses in which shells are carried through the press by an apertured endless belt. Belt-based presses are capable of operating at higher speeds than rotary-type presses which carry the shells through the work stations along a circular-arc path by means of a "starwheel". The desire to increase production rate has further led to the development of "multiple-out" belt-based presses which operate upon two or more lanes of shells at the same time, and are therefore capable of producing two or more times as many can ends per minute as a "one-out" press operating at the same stroke rate.

Manufacturers of easy-open can ends typically produce ends of various sizes for various types of food and beverage cans. For example, currently, can ends ranging from about 1-inch diameter to about 4-inch diameter are commonly used in the canning industry. Thus, high-volume producers of can ends often employ a number of multiple-out belt-based presses, with each press being typically configured to manufacture can ends of only one size. However, these multiple-out presses are quite expensive, and consequently, low-volume producers of can ends often find that it is economically not practical to purchase several such presses in order to manufacture can ends of various sizes.

One way to solve this problem is to employ one press and reconfigure it to run different can end sizes. Although this solution is workable, substantial changes must be made to a typical single-size dedicated press in order to reconfigure it to process shells of a different size. For instance, a press is configured to have a specific "index" (i.e., center-to-center spacing between adjacent end stations) corresponding to the shells to be processed such that the shells are sufficiently spaced apart along the belt to have sufficient belt material between adjacent shell-carrying apertures and to have sufficient end tool working room, but close enough together to attain maximum throughput. If a different size shell is to be converted in the press, the index may have to be changed. Thus, when reconfiguring a press that is designed to process 2-inch diameter shells, which typically has a press index of about 3 inches, to enable the press to process 4-inch diameter shells, the press index necessarily must be increased to a value greater than 4 inches. Changing the press index, however, necessitates substantial changes in hardware, including the end tooling, the dies plates for mounting the end tooling on the press members, the endless belt, and the intermittent drive unit which drives the belt. Furthermore, changing end diameter frequently necessitates relocating the tooling for making the operating tabs as well as the tooling for staking the tabs onto the ends, since the integral rivet is usually not in the center of the end and therefore a change in end diameter translates into a change in rivet location. Such a change in tab tooling typically would require completely redesigning the mounting for the tab tooling on the press members.

Furthermore, different can end sizes often require different operating tabs. In order to minimize scrap during manufacturing of the operating tabs within a multiple-out conversion press, the interconnected tabs of the tab strip are advantageously located as close together as possible both in the direction along the strip and in the direction perpendicular thereto. Typically the most economical arrangement results in the tabs in adjacent rows being slightly staggered with respect to each other. As is well known, the resulting configuration of the tab strip completely determines the required "spread" of adjacent end tooling lanes (i.e., the center-to-center distance between adjacent lanes in the direction perpendicular to the direction of belt travel) as well as the "offset" of the lanes (i.e., the distance in the direction of belt travel between the center of an end station in one lane and the center of the corresponding end station in the adjacent lane). Reconfiguring a multiple-out press to run a different shell size with a different operating tab therefore frequently results in a change in both the "spread" and "offset" of the lanes. These changes in turn necessitate a complete redesign of the end tooling mounts.

Moreover, reconfiguring a typical press necessitates significant changes to the downstacker. A typical downstacker in a belt-based press includes a number of guide chutes corresponding to the number of end tooling lanes. Associated with each guide chute are typically two helical feed screws which engage the edge of the lowermost shell in a stack of shells and rotate to advance the shell downward through a feed opening at the lower end of the guide chute overlying a belt aperture. Reconfiguring a typical conversion press downstacker necessitates substantial changes in the downstacker structure for mounting the feed screws and their associated shafts and drive pulleys.

Apart from the problems associated with reconfiguring prior conversion presses, another significant problem with such presses is the balancing of press loads. The loads exerted on shells in a conversion press may reach several tons at certain end stations, particularly those stations in which the integral rivet is formed, while at other end stations the loads may be a fraction of a ton. In order to reduce wear and tear on the drive system components which drive the reciprocating press member as well as to maintain safe operation of the press, it is desirable to minimize the moments experienced by the reciprocating member about its center. To minimize moments, it is desirable to arrange the end stations and tab stations in such a manner that the total moments resulting from the sums of the moments produced at each of the individual end and tab work stations are minimized. In many conventional conversion presses, however, the path along which the tab strip travels to the tab-staking location is oriented normal to the path traveled by the can ends. The path defined by the tab-forming tooling typically is also oriented normal to the end path. The tab strip must travel between the two press supports on one side of the press during both the tab-forming and the tab-staking phases, since all tab-forming and tab-staking operations are preferably performed within the "footprint" of the press defined by the press supports. As a consequence, typically the tab-staking location in many such prior conversion presses must necessarily be approximately centrally located with respect to the press supports. Moreover, since the end must have the tear panel and the button which will become the integral rivet fully formed before the tab-staking operation can be performed, the high-load rivet-forming operations in such presses must of necessity be located toward the upstream press support. This results in difficulty balancing the loads in such presses.

SUMMARY OF THE INVENTION

The present invention overcomes the drawbacks noted above by providing a conversion press which has a single end tooling lane with a large and fixed "index" but which nevertheless is capable of operating at speeds typical of a press having a significantly smaller index, which can be reconfigured to process shells of widely varying sizes without changing the index and without changing a large number of parts, which has a unique tab-forming tooling arrangement easily adjusted to accommodate changing can end size, and which has a unique downstacker that is readily adjustable to dispense shells of various sizes.

To these ends, and in accordance with the principles of the present invention, the conversion press advantageously has an index of about 5 inches, so that shells up to about 4 inches in diameter may be processed. The press advantageously has only one end tooling lane, thereby eliminating lane spreads and offsets associated with typical multiple-lane presses. The press further advantageously includes an adjustable downstacker and a slidable mount for the tab-forming tooling. As a consequence, reconfiguring the press to process a different shell size is easily accomplished by simply changing end tooling, changing the endless belt, and making some minor adjustments to the downstacker. Additionally, accommodating a change in rivet location and/or tab design is easily accomplished by simply slidably repositioning the tab tooling mounts and/or changing the tab-forming tooling.

The press further incorporates a tab arrangement wherein the tab-forming tooling and the tab-staking tooling define a substantially straight path oriented oblique to the end path traversed by the shells, with all of the tab-forming tooling located on one side of the end path, and the tab-staking tooling located behind the press upright at the downstream end of the press nearer the discharge end. Locating the tab-staking station nearer the discharge end of the press makes it possible to perform the high-load rivet forming operations closer to the center of the press longitudinal centerline (i.e., closer to the mid-point between press uprights), thereby making it easier to balance moments about the press transverse centerline which bisects the space between the uprights. Moreover, to facilitate balancing the moments about the longitudinal centerline, the end tooling is advantageously spaced on one side of the longitudinal centerline parallel thereto and the tab-forming tooling is located on the other side of the longitudinal centerline.

The press also includes an adjustable mount system for the tab-forming tooling which facilitates rapid reconfiguration of the tab-forming tooling when shell size is changed. Specifically, the upper tab-forming tooling is secured to an upper tab base which is selectively positionable or slidable on the reciprocating press member along the tab path, and the lower tab-forming tooling likewise is secured to a lower tab base which is similarly selectively positionable or slidable on the stationary press member. Thus, when the press is reconfigured and the tab-forming tooling must be relocated to account for a change in rivet location, the tab bases are shifted along the tab path closer to or farther away from the tab-staking location the appropriate distance.

A further benefit of the press in accordance with the principles of the present invention is that a complete change in tab-forming tooling does not necessitate a complete redesign of the end tooling, as it does in a typical multiple-out press in which the spreads and offsets between the end tooling lanes typically change whenever the tab design changes.

The press further includes a downstacker which is easily adjustable to dispense shells of various sizes with minimal changes in parts. The downstacker includes at least two, and advantageously three, helical feed screws whose positions relative to the guide chute and to each other are adjustable. Reconfiguring the downstacker to dispense shells of a different size is a simple matter of changing the guide chute and adjusting the positions of the feed screws so that the feed screws properly engage the curled edge of the lowermost shell in the stack contained in the guide chute.

By virtue of the foregoing, there is thus provided a versatile conversion press for the manufacture of easy-open can ends of a variety of sizes, which is rapidly and easily reconfigurable with minimal parts changes, and which facilitates balancing of press moments.

The above and other objects and advantages of the present invention shall be made more apparent from the accompanying drawings and the description thereof.

BRIEF DESCRIPTION OF THE DRAWING

The accompanying drawings, which are incorporated in and constitute a part of this specification, illustrate an embodiment of the invention and, together with a general description of the invention given above, and the detailed description of the embodiment given below, serve to explain the principles of the invention.

DETAILED DESCRIPTION OF SPECIFIC EMBODIMENTS

Figure 1:
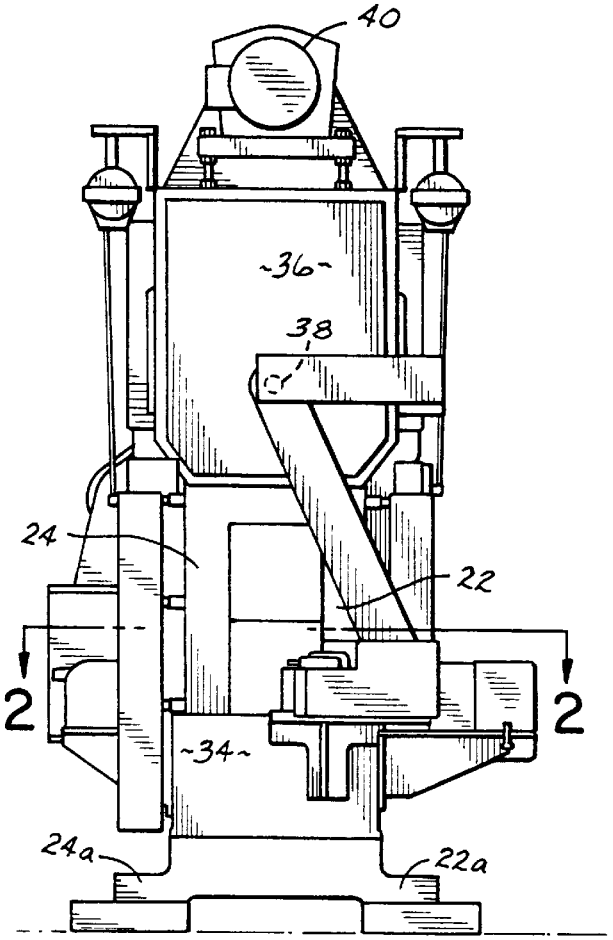
FIG. 1 is an end elevational view of a conversion press in accordance with the principles of the present invention.
Figure 3:
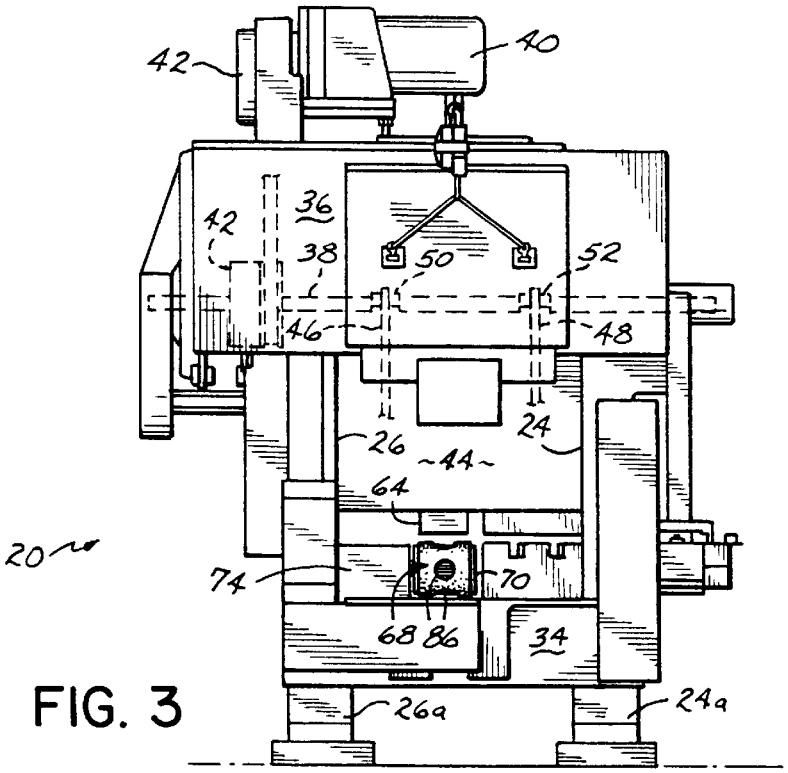
FIG. 3 is a front elevational view of the conversion press of FIG. 1.
Figure 2:
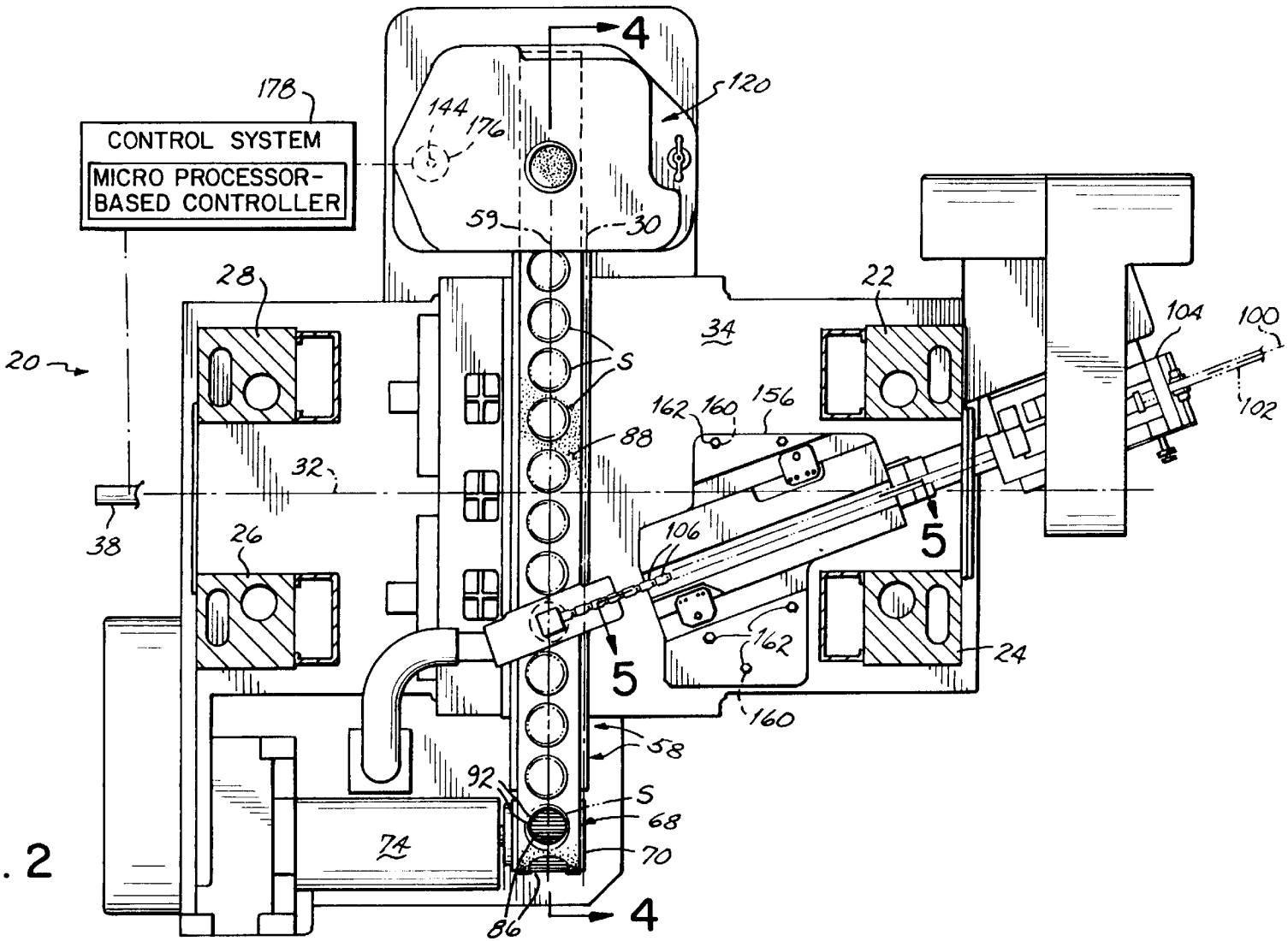
FIG. 2 is a plan view cross-section taken along the line 2—2 of FIG. 1.

FIGS. 1—3 depict various views of a one-out conversion press 20 in accordance with the principles of the present invention. The press 20 has a support structure which includes four press uprights 22, 24, 26, and 28. The uprights 22–28 are supported on a stationary press member 34 which in turn is supported by feet 22*a*, 24*a*, 26*a*, and 28*a*, respectively, the feet being spaced apart to provide a support base having a longitudinal centerline 30 and a transverse centerline 32 (FIG. 2). The uprights 22–28 support a press crown 36 in which is mounted a rotating crankshaft 38 (shown in dotted line in FIG. 1) aligned with the press transverse centerline 32. The crankshaft 38 is rotatably driven by a motor 40 via a clutch and flywheel 42, in known manner. A reciprocating press member 44 is supported by connecting rods 46 and 48 which are reciprocatingly driven in conventional manner via crank eccentrics 50 and 52 formed integral with the crankshaft 38, thereby moving the reciprocating member 44 alternately toward and away from the stationary member 34.

Figure 4:
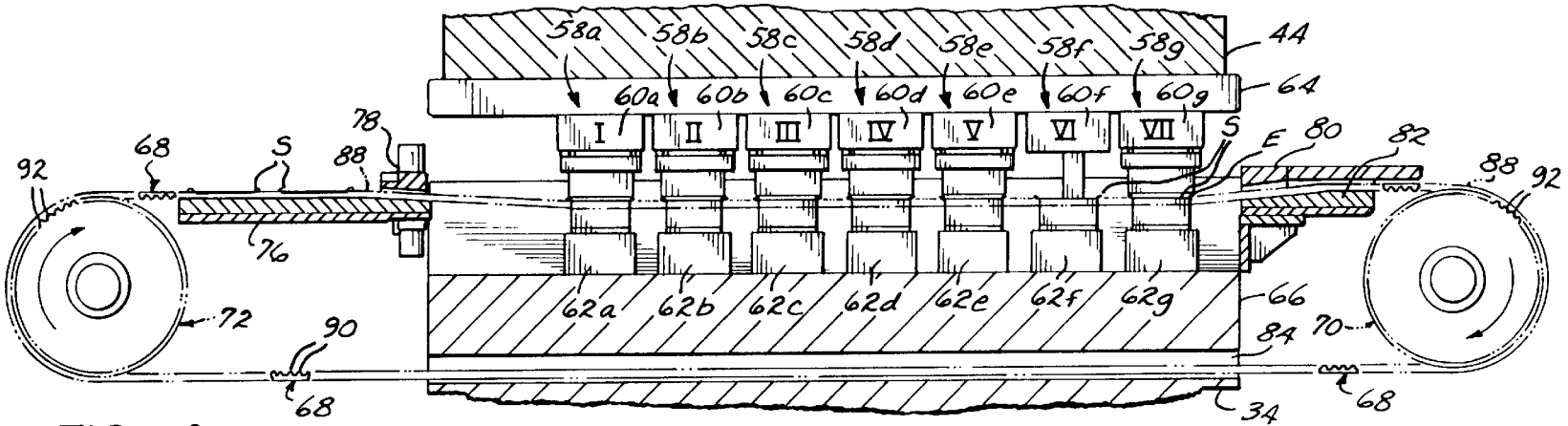
FIG. 4 is a cross-sectional view taken along the line 4—4 of FIG. 2, showing the can end tooling and the main belt mounted about the drums of the belt drive system.

Referring to FIG. 4, the press members 34 and 44 support end tooling arranged into a progression of end stations 58*a*–*g*. The end stations 58*a*–*g* lie along an end path 59 (FIG. 2), and are longitudinally spaced apart along the end path 59 by a predetermined center-to-center distance or "index" amount. The end path 59 is parallel to but, advantageously, offset from the press longitudinal centerline 30 (FIG. 2). Advantageously, the "index" between adjacent end stations 58 is about 5 inches. Thus, as further described below, shells from about 1 inch up to about 4 inches in diameter may be processed in the press 20 without changing the index.

Each end station 58 comprises a pair of end tools, an upper end tool 60 supported on an upper die plate 64 attached to the reciprocating member 44, and a corresponding lower end tool 62 supported on a lower die plate 66 attached to the stationary member 34. It will be appreciated that one or more of the end stations could be made an "idle" station, i.e., a station at which no work operation is performed on the shells. Thus, while each of end stations 58*a*–*g* carries end tooling which performs work operations on the shells, and therefore each set of end tooling 60, 62 is spaced from adjacent sets of end tooling 60, 62 by the predetermined index amount, it is possible to have adjacent sets of end tooling spaced by other integral multiples of, such as twice, the index amount.

Shells S are transported through the progression of end stations 58*a*–*g* by an endless belt 68. The belt 68 is looped about a pair of generally cylindrical drums 70 and 72 which are rotatably supported on aprons (not shown) mounted on the press stationary member 34 at opposite ends of the press outside the press uprights. The drum 70 is intermittently driven by an intermittent drive unit 74 (FIG. 2) to advance the belt step-wise through the press. The drum 72 is an idler drum. Intermittent drive unit 74 is driven by the crankshaft 38 via a mechanical linkage (not shown) therebetween, in known manner.

An upper flight of the endless belt 68 extends from idler drum 72, through chutes 76 and 78, between the upper end tools 60 and the lower end tools 62, through chutes 80 and 82, and to drive drum 70. A lower flight of the belt extends from idler drum 72 through a channel 84 in the lower die plate 66 to drive drum 70.

Figure 7:
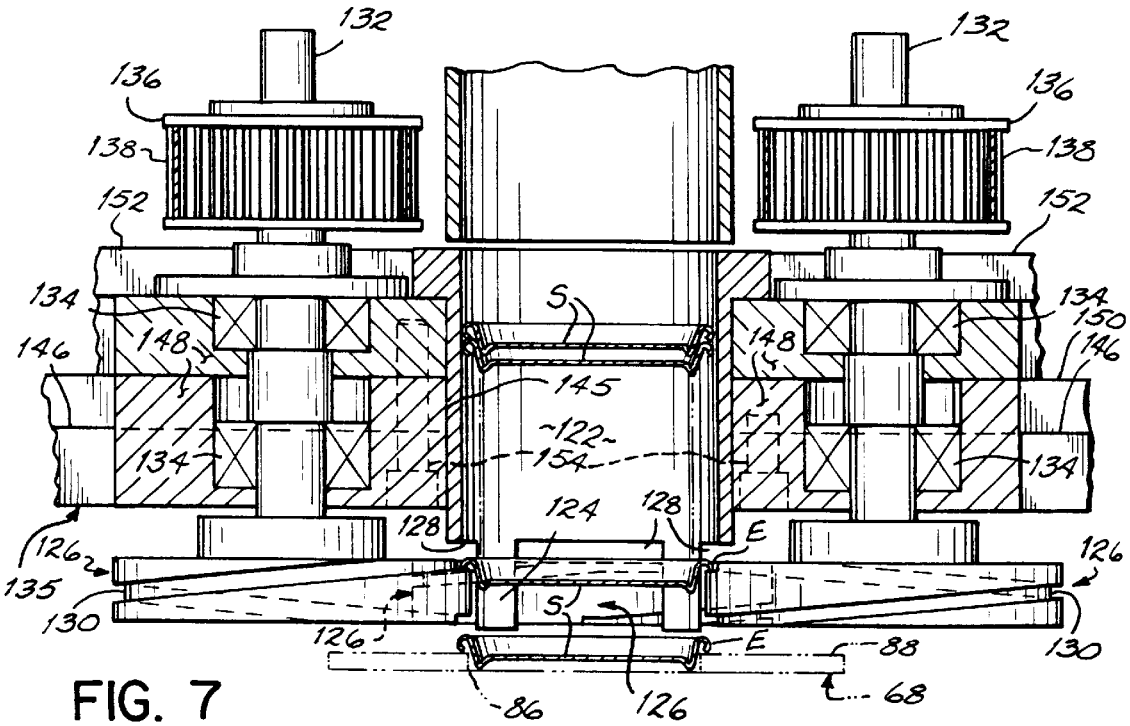
FIG. 7 is a cross-sectional view taken along 7—7 of FIG. 6, showing the downstacker feed screw assemblies.

The belt 68 has a plurality of spaced-apart apertures 86 formed through it for supporting shells S as the belt advances through the press, as shown in FIG. 2. Each shell S rests in an aperture 86 with a curled edge E of the shell supported on the upper surface 88 of the belt (FIG. 7). The apertures 86 are spaced apart along the length of the belt, the center-to-center spacing of the apertures being equal to the center-to-center spacing (i.e., the index) between adjacent end stations 58, which, as already noted, is advantageously about 5 inches. The belt intermittently advances shells S along the end path 59 between the end tools 60 and 62 parallel to the longitudinal press centerline 30. When reciprocating press member 44 is partway through its upward stroke, the intermittent drive unit 74 begins to rotate drive drum 70 to advance the belt. Before reciprocating member 44 reaches the bottom of its next downward stroke, intermittent drive unit 74 stops the rotation of drive drum 70 to bring the belt to rest with shells S aligned with the end stations 58*a–g* between upper and lower end tools 60*a–g* and 62*a–g*. A vacuum chamber (not shown) applies a vacuum below the belt apertures 86 to draw shells S downwardly against the belt in order to prevent unwanted rotation of shells S, as is well known. Reciprocating member 44 then reaches the bottom of its stroke and engages shells S between upper end tools 60*a–g* and lower end tools 62*a–g*. Reciprocating member 44 then begins its upward stroke, and the cycle is repeated. Thus, with each press stroke, the belt 68 is advanced a linear distance equal to the press index or spacing between end stations 58*a–g*.

The belt 68 is advantageously cast in an endless loop from an aramid fiber-reinforced urethane material. The surface of the belt in contact with drums 70 and 72 has integral teeth 90 which are shaped to mesh with corresponding teeth 92 on the outer surfaces of drums 70 and 72. The construction of belt 68 and the tooth configurations of the belt and drums are substantially described in U.S. Pat. No. 4,605,389, entitled "Toothed Belt and Sprocket", the disclosure of which is incorporated herein by reference in its entirety. The toothed configurations of the belt 68 and drums 70 and 72 permit reliable indexing of the belt without slipping on the drums, even at high press speeds, for example, about 500 strokes per minute. The belt 68 advantageously has a thickness measured at a belt tooth of about 0.375 inch in order to provide sufficient belt strength and transverse bending stiffness (i.e., in the direction perpendicular to the direction of belt travel) when configured for approximately 4-inch diameter shells. Transverse bending stiffness must be adequate to maintain a proper sealing contact of the belt with the vacuum chamber which applies vacuum to the shells to prevent them from rotating. The combination of the belt thickness of about 0.375 inch and the index of about 5 inches ensures such adequate belt strength and stiffness even when the belt is configured for 4-inch shells.

End stations 58*a–g* comprise a progression of seven stations. A shell S progresses through the stations 58*a–g* and emerges from the last station as a completed easy-open can end, complete with attached operating tab, the formation of which is further described below. The end tooling 60 and 62 is of conventional design. As an example of a typical set of end tooling, end stations 58*a–g* may include the following:

| Station | Work Operation Performed |
|---|---|
| I | Form bubble |
| II | Form button, panel coin |
| III | First panel forming |
| IV | Form score line for tear panel |
| V | Second panel forming |
| VI | Stake tab onto end |
| VII | Lettering; can end complete |

Figure 9:
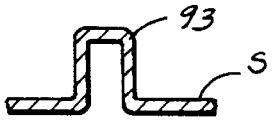
FIG. 9 is a cross-sectional view of the portion of a central circular panel of a shell in which a button has been formed by the end tooling.
Figure 10:
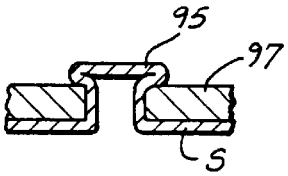
FIG. 10 is a cross-sectional view similar to FIG. 9 in which the button has been deformed to form an integral rivet attaching an operating tab to the shell.

Stations 58*a* and 58*b* (stations I and II above) form a button 93 in shell S as shown in FIG. 9. The button 93 is deformed by the end tooling at the tab-staking station 58*f* (station VI above) to form an integral rivet 95 which attaches an operating tab 97 to the shell S, as shown in FIG. 10.

It will be appreciated that although the press 20 is illustrated as having seven end stations 58*a–g* all of which carry end tooling which performs work operations upon the shells S, one or more of these stations could be made an idle station at which no work operation is performed on the shells. At such an idle station, "dummy" tooling may be employed which engages the shells but does not perform any work operation upon the shells, as is well known.

The press 20 further includes tooling for forming operating tabs. Thus, with reference to FIG. 5, the stationary press member 34 supports a progression of lower tab tools 94 and the reciprocating press member 44 supports a progression of corresponding upper tab tools 96. The tab tools 94 and 96 define a series of tab work stations 98 spaced apart and arranged along a tab-forming path 100 as shown in FIG. 2. A strip of tab stock material 102 is fed by a push-type tab stock feeder 104 through the tab work stations 98 where the strip is formed into a strip of interconnected operating tabs 106. The strip of tabs is then fed to a pair of tab-staking tools 60*f* and 62*f* at the tab-staking station 58*f*, and the tab-staking tools 60*f* and 62*f* separate each tab from the strip and attach it to a fully-formed can end (as shown in FIG. 10) disposed at the tab-staking station. The remaining skeleton of the tab strip is then chopped by a scrap chopper (not shown) and disposed of, in known manner.

Figure 2A:
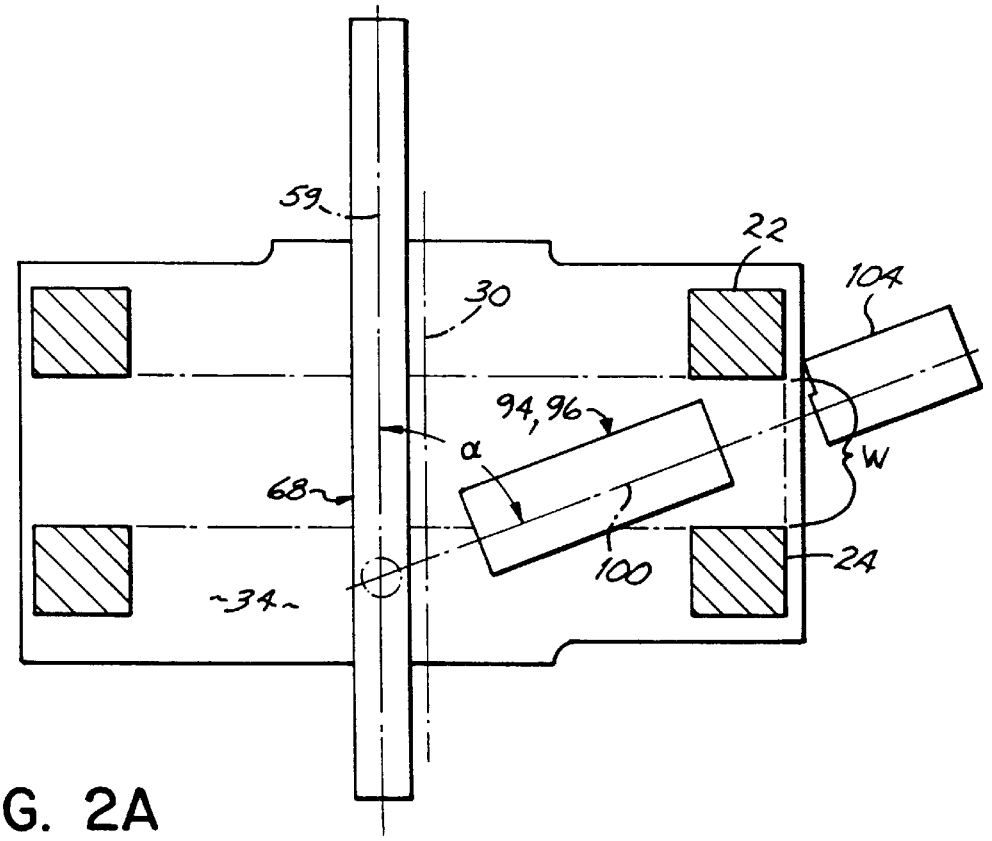
FIG. 2A is a schematic plan view of a press to illustrate the press "window" and to show the locations of the tab-forming tooling and the tab-staking tooling with respect to the window.

The tab-forming path 100 extends from the tab stock feeder 104 which is secured to the stationary press member 34 in front of the press upright 22 near the upstream end of the press, through the window W defined between upstream press upright 22 and downstream press upright 24, through the tab tooling 94 and 96, and to the staking tools 60*f* and 62*f*, forming a substantially straight path at an oblique angle a of about 70 degrees to the end-forming path 59. The term "window" as used herein denotes the volume defined between two parallel planes perpendicular to the end path 59 and passing through the inner edges of the uprights 22 and 24, respectively, as shown schematically in FIG. 2A. Tab tools 94 and 96 are all located to one side of the longitudinal centerline 30 adjacent the uprights 22 and 24 and substantially within the window W. However, the tab-staking station 58*f* is located on the opposite side of longitudinal centerline 30 and downstream of the window W, such as behind the downstream upright 24 as shown in FIG. 2.

It will be appreciated that the moments about the longitudinal and transverse centerlines which result from the forces acting on the reciprocating press member 44 must be minimized in order to maintain acceptable press stability and to minimize wear on the mechanical linkages which drive and guide the reciprocating press member 44. It will also be appreciated that the forces required for forming the bubble (station 58*a*) and button (station 58*b*) which will become the integral rivet and for performing the first panel forming (station 58*c*) are relatively large in comparison to the forces exerted at the other end stations, and therefore have the potential for significantly influencing the overall moments on the reciprocating press member 44 if these stations are offset from the center of the press defined by the intersection of the transverse and longitudinal centerlines. In contrast, the loads for scoring (station 58*d*), second panel forming (station 58*e*), staking (station 58*f*) and lettering (station 58*g*) may be significantly smaller. In accordance with the principles of the invention, the press 20 has the tab-staking station 58*f* located well downstream such as behind the downstream press upright 24 and therefore outside of the window W between the uprights 22 and 24. This arrangement makes it possible to locate the bubble-forming, button-forming, and first panel forming stations closer to the press center, in contrast to a conventional press in which the tab-staking station is located closer to the center of the press and which therefore must have these high-load stations farther upstream of the press center. Accordingly, the press 20 facilitates improved balancing of moments about the press transverse centerline 32.

Balancing of moments about the longitudinal centerline 30 is accomplished by locating the end path 59 parallel to but offset to one side of the longitudinal centerline 30, and locating the tab tools 94 and 96 on the opposite side of the longitudinal centerline 30, as shown in FIG. 2.

Figure 5:
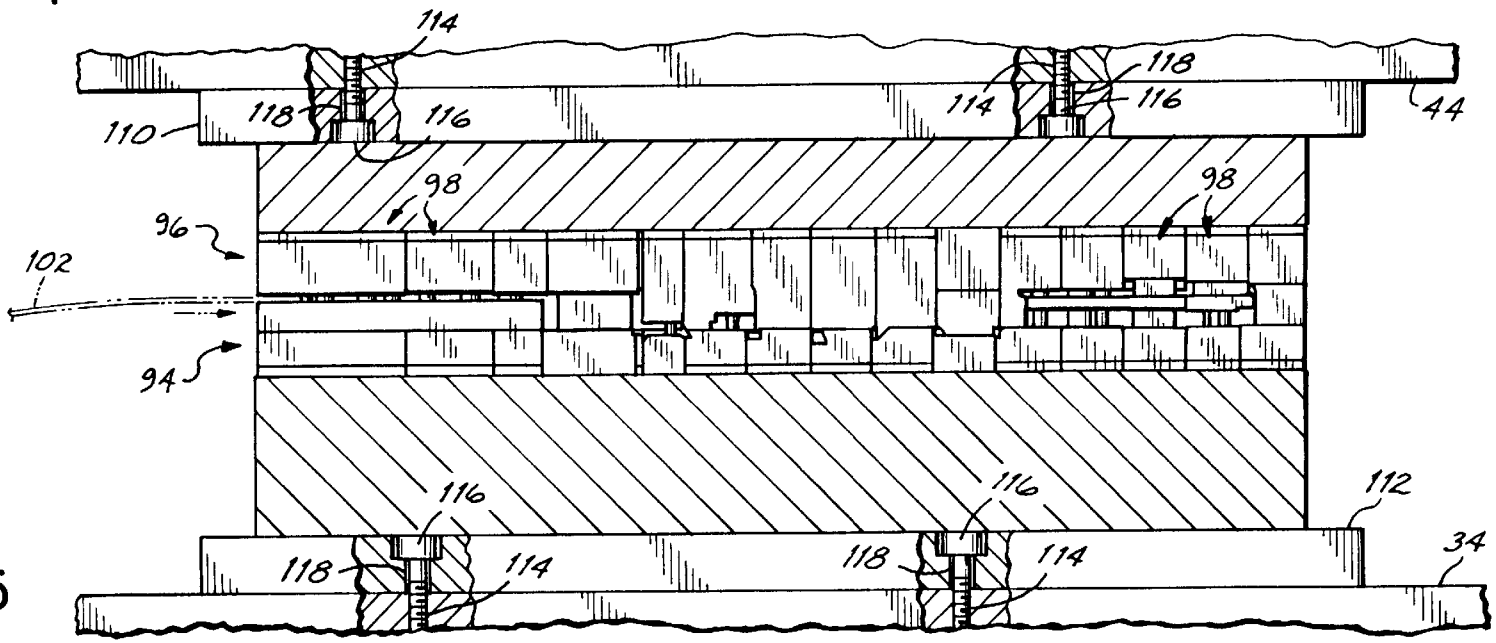
FIG. 5 is a cross-sectional view taken along line 5—5 of FIG. 2 showing the tab-forming tooling and its mounting on the press members.

With reference to FIGS. 2 and 5, the unique mounting system for the tab tooling facilitates rapid accommodation of the tab system when changing end size. Upper tab tools 96 are secured to an upper tab base 110 which in turn is fastened to the reciprocating press member 44, and lower tab tools 94 are secured to a lower tab base 112 which in turn is fastened to the stationary press member 34. The stationary and reciprocating members 34 and 44 have a series of sets of mounting holes 114 which line up with corresponding fasteners 116 extending through holes 118 in the tab bases 110 and 112. The sets of mounting holes 114 are spaced apart along the oblique line of tab path 100. Thus, upper tab base 110 along with upper tab tooling 96 may be repositioned along the tab path 100 as a single unit by aligning the fasteners 116 with the appropriate set of mounting holes 114, and likewise the lower tab base 112 and lower tab tooling 94 may be similarly repositioned as a single unit. The mounting holes 114 in the press members are located in accordance with predetermined rivet locations at the tab-staking station corresponding to the various can end sizes to be processed in the press 20. Therefore, when changing can end size, the tab tooling units are simply repositioned on the press bases and fastened thereto via the appropriate set of mounting holes 114 in order to ensure that the tab strip is properly aligned with the tab-staking tools 58*f*.

Figure 6:
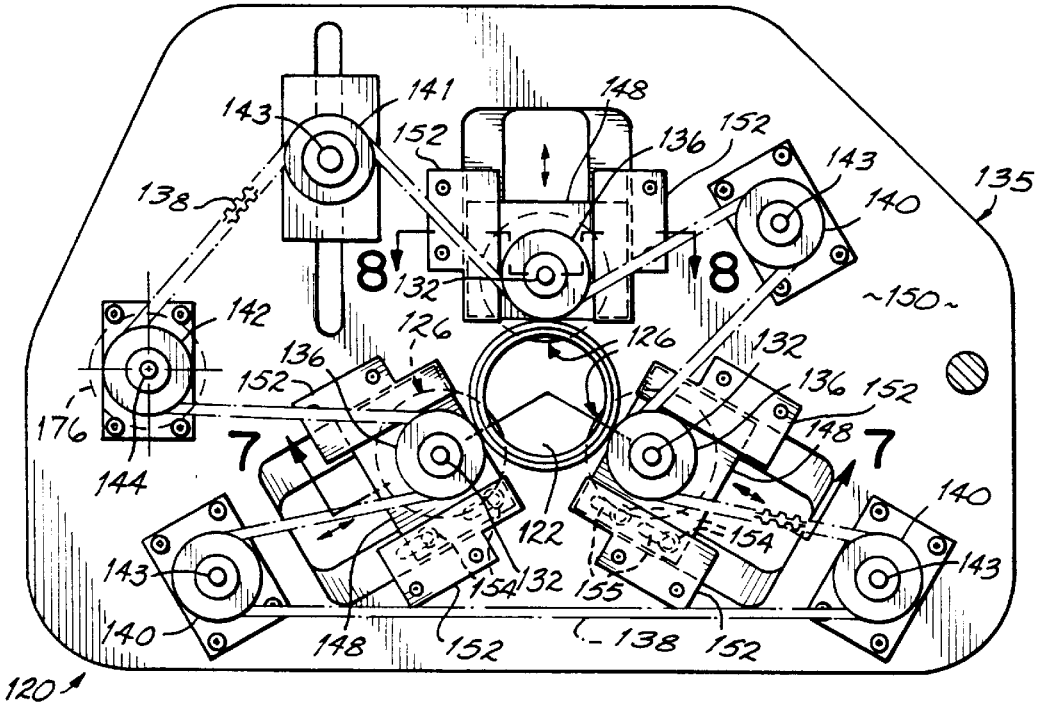
FIG. 6 is a plan view of the downstacker with the cover removed, showing the routing of the downstacker drive belt for driving the feed screws.

The press 20 further has features permitting the apparatus which supplies shells to the endless belt 68 to be readily reconfigured to dispense shells of a different size with minimal change of parts. With reference to FIGS. 2, 6, and 7, shells S are supplied to the endless belt 68 by a downstacker 120. The downstacker includes a guide chute 122 which contains a stack of shells S to be supplied to the belt 68. The guide chute 122 has a feed opening 124 at its lower end which is generally in vertical alignment with a belt aperture 86 when the belt is momentarily brought to rest by the belt drive system. Three helical feed screws 126 are approximately equally spaced around the periphery of the feed opening 124, partially intruding into the guide chute 122 through lateral openings 128. Each helical feed screw 126 has a helical groove 130 in its outer surface which is adapted to engage the curled edge E of the lowermost shell S in the stack contained in the guide chute 122. The three feed screws 126 are synchronized in position such that the uppermost extent of the helical grooves 130 of all three screws simultaneously engage the edge of the lowermost shell S as shown in FIG. 7. Simultaneous rotation of the three feed screws 126 causes the lowermost shell S to advance downwardly through the feed opening 124 until the shell falls free of the feed screws and drops into a belt aperture 86 aligned beneath the feed opening, as is well known.

The feed screws 126 are mounted on vertical shafts 132 supported in bearings 134 which are adjustably mounted on a downstacker platen 135 in a manner described below. The upper end of each shaft 132 has a pulley 136 mounted thereon for rotatably driving the shaft. A downstacker drive belt 138 is wrapped around the pulleys 136, over pulleys 140 and adjustable tension roller 141, and over a drive pulley 142. The pulleys 140 and tension roller 141 are mounted on shafts 143 which are supported in bearings (not shown) secured to the downstacker platen 135. The drive pulley 142 is mounted on the upper end of a downstacker drive shaft 144 which is supported in bearings (not shown) secured to downstacker platen 135. Rotation of the downstacker drive shaft 144 causes the drive pulley 142 to drive the drive belt 138 which rotates the pulleys 136 and thereby rotates the feed screws 126 simultaneously and dispenses shells S one at a time from the feed opening 124 into a belt aperture 86.

Figure 8:
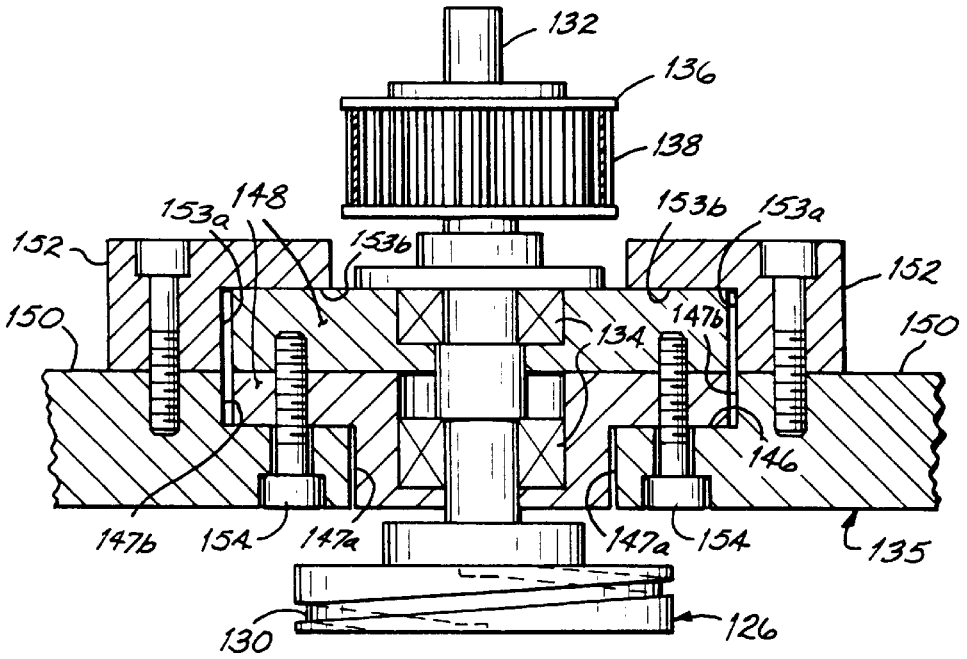
FIG. 8 is a cross-sectional view taken along line 8—8 of FIG. 6, showing the adjustable mounting of one of the feed screws on the downstacker platen.

The feed screws 126 are adjustably secured to the downstacker platen 135, thereby permitting the downstacker to be readily reconfigured to dispense shells of a different diameter. With reference to FIGS. 6–8, the guide chute 122 extends through a circular hole 145 in the downstacker platen 135. The downstacker platen 135 has three slots 146 formed therein which are approximately equally spaced around the perimeter of the hole 145 and which extend horizontally outward from the hole 145 in a radial direction with respect to the hole 145. Each slot 146 in vertical cross-section is stepped, with a narrower lower portion defined by vertical surfaces 147*a* and a wider upper portion defined by vertical surfaces 147*b*. Fastened to the upper surface 150 of downstacker platen 135 on opposite sides of each slot 146 are a pair of upper track members 152 each of which is L-shaped in vertical cross section and which includes a vertical surface 153*a* and a horizontal surface 153*b*. The track members 152 are secured to the platen 135 such that the vertical surfaces 153*a* are approximately flush with the vertical surfaces 147*b* of the slot 146 and the horizontal surfaces 153*b* are facing downward toward the platen 135. Thus, each pair of track members 152 and slot 146 define a T-shaped track extending radially outward from the hole 145 and guide chute 122. Each feed screw shaft 132 is supported by bearings 134 which are secured within a pair of mounting blocks 148 which reside within the radial track. The mounting blocks 148 when assembled have a vertical cross section which approximately matches that of the radial track defined by surfaces 147*a*, 147*b*, 153*a*, and 153*b*, the mounting blocks being slightly narrower than the width of the track to permit the blocks to freely move within the track in the radial direction with respect to the hole 145. The mounting blocks 148 are secured in a fixed position relative to the platen 135 by fasteners 154 which extend through elongated holes 155 in the platen 135. Thus, each entire feed screw assembly, including the mounting blocks 148, bearings 134, shaft 132, and feed screw 126, may be slidably adjusted toward and away from the guide chute 122 by loosening the fasteners 154 and sliding the mounting blocks 148 within the radial track to relocate the feed screw in the desired location with respect to the feed chute 122, and then securing the mounting blocks 148 in place via the fasteners 154. Thus, when reconfiguring the downstacker to dispense shells of a different size, the guide chute 122 is changed and the feed screw assemblies are simply moved to the appropriate positions for the feed screws 126 to engage the edge E of the lowermost shell S, and are secured in those positions.

With reference to FIG. 6, the downstacker drive shaft 144 is driven in synchronization with the intermittent motion of the endless belt 68 by a servomotor 176. The servomotor 176 is controlled by a control system including a microprocessor-based controller 178 (FIG.2), which receives position-indicating signals from the servomotor 176 and from an encoder (not shown) mounted on the press crankshaft 38, and regulates the rotation of the servomotor 176 via a feedback loop in order to maintain synchronization between the downstacker 120 and the endless belt 68. The servomotor control system is substantially described in my copending U.S. patent application Ser. No. 08/778,814, entitled "Servo-Driven Downstacker", filed Jan. 3, 1997, and assigned to the assignee of the present application, the disclosure of which is incorporated in its entirety herein by reference. That patent application also describes a method of operating a press with a servo-driven downstacker whereby the downstacker may be engaged "on the fly" during a tab stock thread-up procedure, eliminating one of the press stops ordinarily made with presses having mechanically driven downstackers. Such method of press operation is fully applicable to the press 20 described herein.

In use, the press 20 is prepared for processing shells of a given size by installing a belt 68 having appropriately sized apertures 86. Suitable end tools 60, 62 are installed, and suitable tab tools 94, 96 are installed on the tab bases 112, 110, respectively. The tab bases 110 and 112 are positioned and secured on press members 34 and 44 so as to ensure that finished tabs in the tab strip 102 are properly aligned with the tab-staking tools 60*f*, 62*f*. The downstacker 120 is configured by installing the appropriately sized guide chute 122 and adjusting the positions of the feed screw assemblies to ensure that the feed screws 126 engage the edge E of the lowermost shell S in the guide chute 122. The guide chute 122 is filled with shells and the tab stock feeder 104 is threaded with a strip of tab stock. A number of preliminary operations are conducted, such as running the press for a number of cycles to thread the tab stock all the way through the tab tooling and to produce and present shells to the tab-staking station 58*f*, which operations are well known in the art, and the press is started. The downstacker 120 dispenses shells S through feed opening 124 into the apertures 86 of the intermittently advancing belt 68, and the belt 68 carries the shells through the end stations 58. Simultaneously, tabs are formed in the tab tooling. The tabs are staked onto the ends at station 58*f*, final lettering is completed at station 58*g*, and the completed easy-open can ends are discharged from the press.

From the foregoing description of the press 20, it will be appreciated that reconfiguring the press to run a different shell size requires relatively minor parts changes, unlike prior conversion presses in which the press index typically is changed when changing shell size. More specifically, with respect to the downstacker and the shell transport system, only the belt 68 and the guide chute 122 need be changed. Additionally, it may be necessary, as with prior conversion presses, to change the upper and lower end tooling 60 and 62, depending on the end design to be produced. However, in contrast to prior conversion presses in which reconfiguring a press means changing the index, which typically requires a complete change of not only the end tooling but the die plates and end tooling mounts, the large fixed index of the press 20 permits the same die plates and tooling mounts to be used over a wide range of shell size.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. For example, while the illustrated embodiment of the press 20 is configured to process circular shells, other shell types such as square or rectangular shells could be processed by suitably adapting the belt 68 and the downstacker 120 for such shell types. Furthermore, while the press 20 includes three adjustably mounted feed screws 126, a different number of feed screws, such as two or four, could be used. In particular, four feed screws may be especially suitable in the case of square or rectangular shells. Moreover, while in the press 20 the lower press member is stationary and the upper press member is reciprocating, the principles of the invention could be applied to equal advantage in a press having the upper member stationary and the lower member reciprocating, or having both upper and lower members movable toward and away from each other. Furthermore, the adjustable features of the downstacker 120 may be used to advantage in a conventional press, either one-out or multiple-out, which does not include the advantageous tab-forming and tab-staking arrangements of the press 20. Similarly, while the arrangement of tab-forming tooling and tab-staking tooling of the press 20, which places all of the tab-forming tooling entirely on one side of the end path and which forms a substantially straight path oblique to the end path, is shown in connection with the one-out press 20, such arrangement may be used to advantage in a multiple-out press. Additionally, although the embodiment shown and described depicts a substantially straight path through the tab-forming tooling to the tab-staking tooling at an oblique angle to the end path, the press alternatively could be configured with the tab-forming tooling path oriented generally perpendicular to the end path closer to the upstream end of the press, with the tab strip being brought over the end path and then looped back around to traverse a path to the tab-staking tooling oblique to the end path. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A conversion press having a predetermined index and readily configurable to make easy-open can ends ranging from a first diameter to a second, larger diameter, comprising:

first and second press members movable toward and away from each other;

a single lane of first end tools supported on the first press member along an end path through the press from an upstream end to a downstream end of the press, each first end tool being spaced from an adjacent first end tool by an amount which is an integral multiple of the predetermined index;

a single lane of second end tools vertically aligned with the first end tools and supported on the second press member; and an endless belt mounted about a pair of spaced apart drums and having an upper flight which extends between the first and second press members along the end path, the belt having a single lane of shell-carrying apertures longitudinally spaced apart by an amount equal to the predetermined index;

wherein the predetermined index amount exceeds the second diameter by an amount sufficient to ensure adequate belt strength and stiffness whereby to allow operation of the press to make can ends ranging in diameter from the first diameter to the second diameter without changing the predetermined index.

2. The press of claim 1, the predetermined index being about five inches whereby the press is configurable to process shells ranging from a first diameter of about one inch to a second diameter of about four inches.

3. The press of claim 1, further comprising:

a set of tab-forming tooling which converts a strip of thin metal into completed interconnected operating tabs for attachment to can ends within the press, the set of tab-forming tooling being positioned on the press members entirely on a first side of the press spaced from the end path; and tab-staking tooling adapted to attach completed tabs to can ends, the tab-staking tooling being supported by the press members and located on the end path;

the set of tab-forming tooling and the tab-staking tooling defining a tab path at least a portion of which is oriented at an oblique angle to the end path.

4. The press of claim 3 wherein the tab path is substantially straight from an entrance to the set of tab-forming tooling to the tab-staking tooling and is oriented at an oblique angle to the end path.

5. The press of claim 3, wherein the tab path portion is oriented at an angle of about 70 degrees relative to the end path.

6. The press of claim 3 further comprising a downstacker which dispenses shells into the apertures of the belt, the downstacker including:

a guide chute adapted to contain a stack of shells and having a lower end with a feed opening generally vertically aligned with a belt aperture when the belt is momentarily at rest; and at least two helical feed screws spaced apart adjacent the feed opening and adapted to engage an edge of a lowermost shell in the stack and to advance the lowermost shell downwardly to exit the feed opening upon simultaneous rotation of the feed screws, the feed screws being selectively positionable with respect to each other and to the guide chute.

7. The press of claim 6, wherein the downstacker further includes:

a platen having a hole through which the guide chute extends; and at least two mounting assemblies movably secured to the platen with each feed screw being mounted on a feed screw shaft which is rotatably supported by one of the mounting assemblies, whereby the feed screws are selectively positionable with respect to the guide chute.

8. The press of claim 7, wherein each feed screw mounting assembly at least partially resides within an elongated slot in the platen, each slot extending lengthwise radially outward from the guide chute, and further including fasteners for securing each mounting assembly to the platen at a selected position along the length of the slot.

9. The press of claim 6 wherein there are three helical feed screws approximately equally spaced about the feed opening.

10. The press of claim 3 further comprising a first upright spaced from the end path on the first side thereof adjacent the upstream end of the press, and a second upright spaced from the end path on the first side thereof adjacent the downstream end of the press, the first and second uprights being spaced apart to define a window therebetween, the set of tab-forming tooling being located at least partially within the window and the tab-staking tooling being located downstream of the window.

11. The press of claim 3, wherein the set of tab-forming tooling includes a plurality of first tab tools and a plurality of second tab tools, the first tab tools being mounted on a first tab base secured to the first press member and the second tab tools being mounted on a second tab base secured to the second press member, and further including fastening means associated with the tab bases and the press members for selectively positioning and securing each of the tab bases to the respective press members at preselected positions along the tab path.

12. The press of claim 1, wherein the first press member is a stationary member and the second press member is a reciprocating member.

13. The press of claim 1, wherein the first press member is an upper member and the second press member is a lower member.

14. A conversion press readily configurable to make easy-open can ends ranging from a first diameter to a second, larger diameter, comprising:

first and second press members movable toward and away from each other;

at least one lane of first end tools supported on the first press member along an end path through the press from an upstream end to a downstream end of the press, each first end tool being spaced from adjacent first end tools in the same lane by an integral multiple of an index amount;

at least one lane of second end tools vertically aligned with the first end tools and supported on the second press member;

an endless belt mounted about a pair of spaced apart drums and having an upper flight which extends between the first and second press members along the end path, the belt having a number of lanes of shell-carrying apertures corresponding to the number of lanes of end tooling, the apertures within each lane being longitudinally spaced apart by the index amount;

a set of tab-forming tooling which converts a strip of thin metal into completed interconnected operating tabs for attachment to can ends within the press, the set of tab-forming tooling being positioned on the press members entirely on a first side of the press spaced from the end path; and tab-staking tooling adapted to attach completed tabs to can ends, the tab-staking tooling being supported by the press members and located on the end path;

the set of tab-forming tooling and the tab-staking tooling defining a tab path at least a portion of which is oriented at an oblique angle to the end path.

15. The press of claim 14, wherein the tab path is substantially straight from an entrance to the set of tab-forming tooling to the tab-staking tooling and is oriented at an oblique angle to the end path.

16. The press of claim 14, further comprising:

first and second uprights supported on one of the press members and spaced from the end path on the first side thereof, the uprights being spaced apart to define a window therebetween;

wherein the tab-forming tooling and the tab-staking tooling define a path which extends beyond the window.

17. The press of claim 14, wherein the set of tab-forming tooling is slidable along the press members whereby to adjust the location of the tab-forming tooling with respect to the belt.

18. The press of claim 17, wherein the set of tab-forming tooling includes a plurality of first tab tools mounted on a first tab base secured to the first press member and a plurality of second tab tools mounted on a second tab base secured to the second press member, and further including fastening means associated with the tab bases and the press members for slidably positioning and securing each of the tab bases to the respective press members at preselected positions.

19. The press of claim 14, further comprising a downstacker including:

a guide chute adapted to contain a stack of shells and having a lower end with a feed opening generally vertically aligned with a belt aperture when the belt is momentarily at rest; and at least two helical feed screws spaced apart adjacent the feed opening and adapted to engage an edge of a lowermost shell in the stack and to advance the lowermost shell downwardly to exit the feed opening upon simultaneous rotation of the feed screws, the feed screws being selectively positionable with respect to each other and to the guide chute.

20. The press of claim 19, wherein the downstacker further comprises:

a platen having a hole through which the guide chute extends; and at least two mounting assemblies movably secured to the platen with each feed screw being mounted on a feed screw shaft which is rotatably supported by one of the mounting assemblies, whereby the feed screws are selectively positionable with respect to the guide chute.

21. A method of reconfiguring a conversion press having a predetermined index and adapted to make easy-open can ends of a first size, so as to adapt the press to make ends of a second size, the press including a pair of press members movable with respect to each other, a shell-carrying belt having apertures longitudinally spaced apart by the predetermined index amount and extending along an end path through the press, a pair of tab-forming tooling sets positioned on the press members for converting a metal strip into a strip of interconnected tabs, end tooling spaced apart along the end path by integral multiples of the predetermined index amount for performing operations upon shells carried by the belt including tab-staking tooling for attaching a tab to a can end, and a downstacker having a guide chute with a feed opening and a plurality of feed screw assemblies movably secured to a support in a first position relative to each other and to the guide chute, such that feed screws of the assemblies are spaced apart adjacent the feed opening to engage the edge of a shell contained in the guide chute and positioned to dispense the shell into a belt aperture, comprising the steps of:

changing the belt for a new belt which has apertures sized for carrying shells of the second size, without changing the predetermined index amount between the apertures;

changing the guide chute for a new guide chute sized for containing shells of the second size; and adjusting the position of the feed screw assemblies with respect to each other and to the guide chute by moving each feed screw assembly to a second position without completely removing the assembly from the support such that the feed screws properly engage an edge of a lowermost shell of the second size disposed within the guide chute adjacent the feed opening.

22. The method of claim 21, further comprising:

relocating each of the tab tooling sets on its respective press member as a unit so as to ensure alignment of completed operating tabs with the tab-staking tooling.

23. A conversion press having downstacker which is readily configurable to dispense shells of various diameters, comprising:

first and second press members movable toward and away from each other;

a lane of first end tools supported on the first press member along an end path through the press from an upstream end to a downstream end of the press, each first end tool being spaced from adjacent first end tools by an integral multiple of an index amount;

a lane of second end tools vertically aligned with the first end tools and supported on the second press member;

an endless belt mounted about a pair of spaced apart drums and having an upper flight which extends between the first and second press members along the end path, the belt having plurality of shell-carrying apertures longitudinally spaced apart by the index amount;

and having a downstacker which includes;

a guide chute adapted to contain a stack of shells and having a lower end with a feed opening generally vertically aligned with an aperture of the belt when the belt is momentarily at rest;

a platen having a hole therethrough, the guide chute extending through said hole;

at least two helical feed screws spaced apart adjacent the feed opening of the guide chute and adapted to engage an edge of a lowermost shell in the stack and to advance the lowermost shell downwardly to exit the feed opening upon synchronous rotation of the feed screws, the feed screws being selectively positionable with respect to each other and to the guide chute;

at least two mounting assemblies movably secured to the platen with each feed screw being mounted on a feed screw shaft which is rotatably supported by one of the mounting assemblies, whereby the feed screws are selectively positonable with respect to the guide chute to be adjustable to the diameter of the shell to be converted; and a drive system which rotatably drives the feed screws synchronously with each other and with the motion of the belt; wherein each feed screw mounting assembly at least partially resides within an elongated slot in the platen, each slot extending lengthwise radially outward from the guide chute, and further including fasteners for securing each mounting assembly to the platen at a selected position along the length of the slot.

24. The press of claim 23, further comprising a third selectively positionable helical feed screw, the three feed screws being approximately equally spaced about the feed opening of the guide chute.

25. A method of making an easy-open can end with an attached operating tab, comprising the steps of:

advancing a thin metal shell along an end path between a pair of cooperating end tooling sets mounted on press members movable with respect to each other, and intermittently bringing the shell to rest at predetermined end stations along the end path;

feeding a thin metal strip along a tab path between a pair of cooperating tab tooling sets mounted on the press members and intermittently bringing the strip to rest in synchronization with the shell, the tab path having a portion which is oblique to the end path and intersecting the end path at one of the end stations which includes tab-staking tooling;

sequentially bringing the press members together to engage the end tooling sets with the shell while the shell is at rest at each of the end stations to form features of an easy-open can end including a button for forming an integral rivet, and to engage the tab tooling sets with the metal strip to form a strip of interconnected operating tabs, all of the tab-forming operations occurring on one side of and spaced from the end path;

after the button has been formed, moving one of the interconnected operating tabs into alignment with the tab-staking end station and simultaneously bringing the shell to rest at the tab-staking end station; and bringing the press members together to cause the tab-staking tooling to separate said one of the interconnected operating tabs from the strip and attach said tab to the can end by deforming the button to form an integral rivet.

* * * * *

UNITED STATES PATENT AND TRADEMARK OFFICE

CERTIFICATE OF CORRECTION

PATENT NO. : 5,876,171

DATED : March 2, 1999

INVENTOR(S) : Gregory S. Martin et al

It is certified that error appears in the above-identified patent and that said Letters Patent is hereby corrected as shown below:

Column 15, line 65 (claim 23, line 1), please replace "having downstacker" with --having a downstacker--;

Column 16, line 13 (claim 23, line 16), please replace "having plurality" with --having a plurality--.

Signed and Sealed this

Twenty-seventh Day of July, 1999

*Attest:*

Q. TODD DICKINSON

*Attesting Officer*

*Acting Commissioner of Patents and Trademarks*